United States Patent [19]

Ramsey

[11] Patent Number: 4,923,971

[45] Date of Patent: May 8, 1990

[54] TREATMENT OF ARYLENE SULFIDE POLYMER FIBER

[75] Inventor: Bruce L. Ramsey, Bartlesville, Okla.

[73] Assignee: Phillips Petroleum Company, Bartlesville, Okla.

[21] Appl. No.: 272,562

[22] Filed: Nov. 17, 1988

[51] Int. Cl.[5] ..... C08G 75/14

[52] U.S. Cl. ..... 528/481; 264/340; 264/345; 528/388; 528/491

[58] Field of Search ..... 528/491, 481, 388; 264/340, 345

[56] References Cited

U.S. PATENT DOCUMENTS 3,354,129 11/1967 Edmonds, Jr. et al. ..... 260/79
3,919,177 11/1975 Campbell ..... 260/79.1
4,251,575 2/1981 Brady et al. ..... 427/341
4,299,951 11/1981 Campbell ..... 528/491
4,421,513 12/1983 Tien-Kuei ..... 8/130.1

FOREIGN PATENT DOCUMENTS 0233494 8/1987 European Pat. Off. .

OTHER PUBLICATIONS

Crystallization in Polyphenylene Sulfide-Carbon Fiber Composites, T. W. Johnson & C. L. Ryan, SAMPE Symposium, 4-86, pp. 1537-1548.

*Primary Examiner*—Harold D. Anderson
*Attorney, Agent, or Firm*—Lynda S. Jolly

[57] ABSTRACT

Improved, stronger poly(arylene sulfide) fibers can be produced by treatment of a crystallizable poly(arylene sulfide) fiber with an organic halide, either before or after annealing. Physical properties, such as density and abrasion resistance, can be increased after said treatment.

24 Claims, No Drawings

TREATMENT OF ARYLENE SULFIDE POLYMER FIBER

BACKGROUND OF THE INVENTION p This invention relates to arylene sulfide polymer fibers and monofilaments having improved properties.

In the years following their initial development, poly(arylene sulfide) resins have become commercially important and the products produced therefrom are finding increasing utility due to their outstanding durability, toughness, inertness and versatility. To extend the value of such poly(arylene sulfide) resins and the utility of products prepared therefrom, still further improvements have been sought with regard to improving the properties of fibers to meet the requirements of certain applications.

Fibers of poly(arylene sulfide) possess many desirable properties because of the strength, high melting point, and non-burning characteristics of the polymer. Articles made from fibers of poly(arylene sulfide) are attractive for use in corrosive atmospheres and applications because the polymers from which the fibers are made are highly resistant to most chemicals including commonly used acids and bases. Multifilament and staple fibers can be formed into fabrics by knitting, weaving, or non-woven processes. Monofilament fiber can be woven into belts or screens for use in various applications, such as in the paper-making industry.

However, these fibers, while known to be useful, are also known to have limited physical strength. This lack of strength limits the applications and use of poly(arylene sulfide) fibers. Thus, increasing the polymer strength, as shown by increasing the tensile strength, abrasion resistance, and density, would be a desirable improvement to these poly(arylene sulfide) fibers.

SUMMARY OF THE INVENTION

Therefore, it is an object of this invention to improve the physical properties of arylene sulfide polymers.

It is another object of this invention to improve the tensile strength and abrasion resistance of poly(arylene sulfide) fibers.

It is yet another object of this invention to increase the density of poly(arylene sulfide) fibers.

It is a further object of this invention to provide poly(arylene sulfide) fibers having improved structural characteristics in a simple, economic, and expedient manner.

It is yet a further object of this invention to provide a process of treating, in the presence or absence of heat, arylene sulfide polymers to improve their physical properties.

It has now been found that poly(arylene sulfide) fibers can be treated with an organic halide to improve their physical properties. If said treatment is carried out at an elevated temperature, the resultant physical properties can be further improved. Furthermore, if said organic halide treatment is used in conjunction with pre- or post-heating, i.e. annealing, of the poly(arylene sulfide) fiber, additional physical improvements to the polymer are possible.

DESCRIPTION OF THE PREFERRED EMBODIMENTS

The terms "poly(arylene sulfide)" and "arylene sulfide polymers" as used in this specification are intended to include crystallizable poly(arylene sulfide). Examples of such polymers are described in U.S. Pat. No. 3,354,129, issued Nov. 21, 1967, to Edmonds and Hill (incorporated herein by reference). As disclosed in this patent, these polymers can be prepared by reacting a polyhalosubstituted cyclic compound containing unsaturation between adjacent ring atoms and an alkali metal sulfide in a polar organic compound. The resulting polymer contains the cyclic structure of the polyhalosubstituted compound coupled in repeating units through a sulfur atom. The polymers which are preferred for use in this invention, because of their high thermal stability and availability of the materials from which they are prepared, are those polymers having the repeating unit -R-S- where R is phenylene, biphenylene, naphthylene, benzophenone, or a lower alkyl-substituted derivative thereof. By the term "lower alkyl" is meant alkyl groups having one to six carbon atoms, such as methyl, propyl, isobutyl, n-hexyl, and the like. The preparation of such polymers is disclosed in the above patent of Edmonds et al. The most preferred poly(arylene sulfide) polymers used in the making of fibers are disclosed in U.S. Pat. No. 3,919,177, issued on Nov. 11, 1975, to Campbell (incorporated herein by reference).

The terms "poly(arylene sulfide)" and "poly(arylene sulfide polymers" are also meant to indicate not only homopolymers but also normally solid arylene sulfide copolymers and terpolymers.

The polymers used in this invention are those which have differential scanning calorimeter (DSC) melting temperatures in the range of about 200° to about 500° C. Preferably, these poly(arylene sulfide) polymers have DSC melting temperatures in the range of about 250° to about 320°. If the poly(arylene sulfide) is comprised primarily of poly(phenylene sulfide), the most preferred DSC melting temperature is in the range of about 265° to about 295° C., which is indicative of appropriate properties for the ease in production of monofilament.

As produced, poly(arylene sulfide) is a crystalline polymer, which is usually converted into pellets for ease of handling. Pellets are formed by extruding under heat and pressure and mechanically cutting the extrudate into the desired size. The pellets are dried, or heated, fed into yet another extruder, through a gear pump, which regulates polymer throughput, and finally, through a die to form poly(arylene sulfide) fiber. The fiber is immediately quenched in water or air. Air quenching is preferred in the production of finer, lower denier, fiber. The thus cooled fiber enters a drawing zone where it is heated slightly and drawn to about two to about five times the original fiber length resulting in orientation, but not substantial crystallization of the polymer molecules. The drawn fiber can be wound onto a spool to be used as is, or to be incorporated into or made into a final product.

As used in this disclosure, the term "fiber" includes all types of monofilament, multifilament, as well as staple fibers. A "monofilment" is a single filament, i.e., one strand; a "multifilament" is two or more monofilaments assembled and held together; a "staple" is discontinuous lengths of fibers which have been cut or broken into desired lengths from longer monofilaments or multifilaments.

Treating Agents

Any organic halide, in gaseous or liquid form, can be used to treat poly(arylene sulfide) fibers and monofilaments. Liquid treatment is preferred because a higher concentration of treating agent can contact the fiber. The organic halide, if a liquid, can be used in the pure, undiluted form or diluted in an appropriate diluent. If the organic halide is solid, an appropriate liquid solvent for the organic halide can be used.

The organic halide can be either an aliphatic halide or aromatic halide, wherein the halide is selected from the group consisting of chloride, bromide, iodide, or mixtures thereof. Preferably an aliphatic halide is used as the treating agent. Most preferably, the aliphatic halide is an aliphatic chloride. The most preferred aliphatic chloride is dichloromethane ($CH_2Cl_2$) because it is readily available, easy to handle, and can be used without any dilution.

Treatment Conditions

The conditions under which the process of the present invention can be carried out can vary according to the specific organic halide, or treating compound, used, and the desired results. Although the specific mechanisms involved in the chemical transformations of the present invention are not understood completely, there is, nevertheless, a direct relationship between the severity of the treatment and the level of the chemical and physical changes produced. The treatment severity depends upon the combination of operating parameters used in the process, namely, the temperature of treatment, the time of treatment, the concentration of the treating agent in the treating diluent, and pre- or post-heat treatment. Thus, it is clear that no single condition can alone control the level of the organic halide treatment severity.

Treatment with a treating agent can change the appearance of the fiber. The treating agent can cause the fiber to change from transparent to opaque. The fiber can initially appear transparent and, depending on the treatment conditions, can become hazy, then milky, and finally opaque. Organic halide treatment of the fiber or monofilament can occur either before or after the fiber or monofilament is drawn. Preferably, treatment with the treating agent is done after drawing, for best polymer property improvement.

The organic halide treatment can be for a time which ranges from about one minute to about 72 hours, preferably from about 5 minutes to about 50 hours. Most preferably, the treatment time ranges from about 15 minutes to about 3 hours for the most chemical and physical change relative to treatment time. The treatment temperature of the organic halide can range from about 0° to about 150° C., preferably from about 5° to about 100° C. Most preferably, the organic halide temperature ranges from about 10° to about 50° C. for ease of handling and operability. Ordinarily, pressures in the range of about 0 to about 500 psig can be used. Operation at atmospheric pressure is convenient.

Optionally, the fiber can be heat treated, i.e., annealed, in addition to the organic halide treatment. Annealing of the fiber, if desired, can be done before or after the organic halide treatment. As with the organic halide treatment, the heat treatment parameters can be adjusted to accommodate specific needs or limitations. For example, high temperatures and short times can be employed, or lower temperatures and longer times can be used. Usually, the poly(arylene sulfide) fiber can be annealed at a temperature in the range of about 100° to about 270° C, preferably from about 130° to about 240° C., either before or after subjecting the fiber to the organic halide treatment. Most preferably, the annealing temperature is within the range of about 160° C. to about 220° C, for best property improvements. The length of time for the heat treatment of the poly(arylene sulfide) can varY from about one-half second to about 30 minutes, preferably from about one-half second to about 20 minutes. Most preferably, for convenience, the heat treatment time is within the range of about one second to about 15 minutes. Furthermore, in order to achieve the best property improvements, annealing is done after the organic halide treatment.

As stated earlier, the operating parameters can be varied in order to obtain specifically desired results. The operating parameters also can be varied depending on the equipment processing capabilities. For example, higher temperatures and/or longer treatment times can be used if lower concentrations of treating agent are appropriate. Similarly, with lower temperature, higher concentrations and/or longer treating times can be used. Likewise, with shorter treating times, higher concentrations and/or higher temperatures can be used. Because there are several parameters available in the invention process, many suitable combinations of conditions can be chosen not only to obtain the result desired, but also to provide convenience and ease of operation. For example, high treating temperature with a low treatment time can be traded for a lower treatment temperature and a longer treatment time, if such is more convenient.

The contact of the treating fluid with the article comprising poly(arylene sulfide) resin can be carried out using any suitable mode, such as immersion, and using any suitable apparatus that is compatible with the conditions described above. The contact can be carried out either batchwise or continuously.

The quantity of treating fluid with respect to the extent of the surface area of the fiberous article or articles being treated can vary widely. If desired, a measured amount of treating agent can be contacted with a measured amount of total surface area to be treated such as in a batch treatment operation. Alternatively, the articles to be treated can be contacted batchwise or continuously, with a large excess of the treating fluid under conditions which are sufficient to obtain the desired improvement. As shown in the examples, the specific amounts of treating agent or the specific conditions required to achieve the desired result can be determined by experimentation using a given poly(arylene sulfide) fiber and a given treating fluid.

EXAMPLES

A further understanding of the present invention and its advantages is provided by reference to the following examples. The poly(arylene sulfide) monofilament fibers used in the following examples were prepared from poly(para-phenylene sulfide) polymer (PPS).

EXAMPLE I

Table I shows the effect on the density of poly(phenylene sulfide) (PPS) monofilament with treating compounds. The monofilament was submerged in each compound for one hour at room temperature.

TABLE I

| Run No. | Treating Compound | Density, g/cc |
|---|---|---|
| 101 | None | 1.338 |
| 102 | Freon 113 | 1.335 |
| 103 | Triphenyl phosphate | 1.338 |
| 104 | Sodium hypochlorite | 1.339 |

TABLE I-continued

| Run No. | Treating Compound | Density, g/cc |
|---|---|---|
| | (10% by weight in water) | |
| 105 | Nitrobenzene | 1.340 |
| 106 | N,N—dimethylformamide | 1.340 |
| 107 | Toluene | 1.340 |
| 108 | m-Cresol | 1.340 |
| 109 | Ethylacetate | 1.340 |
| 110 | Acetonitrile | 1.340 |
| 111 | 2-Propanol | 1.341 |
| 112 | Tetrahydrofuran | 1.341 |
| 113 | Methylethylketone | 1.341 |
| 114 | Analine | 1.341 |
| 115 | Hydrochloric acid (concentrated) | 1.341 |
| 116 | Sulfolane | 1.342 |
| 117 | Dimethylsulfoxide | 1.342 |
| 118 | Sodium hydroxide (15% by weight in water) | 1.342 |
| 119 | Glacial acetic acid | 1.342 |
| 120 | Sodium chloride (10% by weight in water) | 1.342 |
| 121 | Sodium hypochlorite (5% by weight in water) | 1.343 |
| 122 | Dichloromethane | 1.350 |

The data in Table I indicate that organic halides, especially aliphatic halides, such as dichloromethane, can increase the density of PPS. Inorganic halides and unhalogenated organic compounds are not as effective in increasing the density of poly(phenylene sulfide) monofilament.

EXAMPLE II

Table II shows the effect on PPS monofilament density when the length of treatment time is varied. The PPS monofilament was treated with dichloromethane at room temperature.

TABLE II

| Run No. | Treatment Time | Density, g/cc |
|---|---|---|
| 201 | None | 1.338 |
| 202 | 5 minutes | 1.339 |
| 203 | 15 minutes | 1.342 |
| 204 | 30 minutes | 1.342 |
| 205 | 60 minutes | 1.350 |
| 206 | 120 minutes | 1.350 |

The data in Table II show that increasing treatment time can increase the density of poly(phenylene sulfide) monofilament.

EXAMPLE III

The data in Table III lists the drawing conditions used to produce monofilaments used for the analyses in this example. The results of these analyses are listed in Table IV. Denier, or linear density, represents the mass, in grams, of 9,000 meters of fiber. Tenacity, as defined in ASTM D2101, is tensile strength expressed as force per unit of linear density (denier) of the unstrained specimen. The testing procedure of ASTM D2101-82 was used to determine tenacity; however, the scale loads used were from about 3500 to about 5000 grams and only one sample per reported result was analyzed, i.e., average values were not determined. Elongation, as defined by ASTM D2101, is the increase in length of a specimen expressed as a percentage of the nominal gage length. The testing procedure of ASTM D2101-82 was followed to determine elongation; however, only one sample per reported result was analyzed, i.e., average values were not determined. Toughness is determined by multiplying the tenacity and elongation analysis results. Density, reported in grams per cubic centimeter (g/cc), was determined in a gradient density column in accordance with ASTM D1505.

Abrasion resistance test results are reported in the number of cycles required to break the fiber or monofilament. Round rod abrasion testing is done by contacting the fiber or monofilament with a rotating round rod testing unit. This testing unit is similar to a hollow tube with a diameter of about six inches. However, the testing unit comprises about 12, 0.175 inch diameter, substantially parallel, equidistant stainless steel rods. One end of each of these steel rods is connected to the circumference of a disc. The other end of each of these steel rods is connected to the circumference of a second disc, which is parallel to the first disc, to give a structure which is similar in design to a circular "bird cage". The steel rods are uniformly spaced in this "bird cage" structure. One end of the fiber to be tested is attached to a stationary point. The fiber is draped over the exterior surface of the "bird cage" testing unit at an approximate 90 degree angle. The lower, free-hanging, vertical portion of the fiber is attached to a 250 gram weight. The "bird cage" testing unit rotates at a rate of 100 revolutions per minute until the fiber breaks. One complete revolution constitutes one cycle.

Another abrasion test, corner abrasion, is performed with a commercially available type of testing unit. This testing unit is available from Custom Scientific Instruments, Inc. in Cedar Knolls, N.J. The testing unit is a 3 inch by 0.5 inch by 0.0312 inch piece of aluminum. All of the corners of the testing unit are approximately right angles. The fiber is suspended over a corner of the testing unit at approximately 90 degrees. The horizontal, upper portion of the fiber is attached to a moveable rod. The lower, free-hanging, vertical portion of the fiber is attached to a 50 gram weight. The moveable rod is moved horizontally to raise and lower the 50 gram weight about three inches, 30 times per minute until the fiber breaks. One complete oscillation, of raising and lowering the 50 gram weight, constitutes one cycle.

TABLE III

| Drawing Condition | Polymer Lot | Roll 1, °C. | Roll 1 ft/min | Heater, °C. | Draw Ratio |
|---|---|---|---|---|---|
| A | 1 | 55 | 20 | 106–107 | 3.3 |
| B | 1 | 45 | 20 | 104 | 4.4 |
| C | 2 | 45 | 20 | 108 | 4.4 |

TABLE IV

| Run No. | Drawing Condition | Processing | Denier | Tenacity, (g/denier) | Elongation, % | Toughness | Density (g/cc) | Round Rod Abrasion | Corner Abrasion |
|---|---|---|---|---|---|---|---|---|---|
| 301 | A | solvent,(1) drawn | 2323 | 1.7 | 15 | 25.5 | 1.354 | 35,100 | 679 |
| 302 | A | solvent,(1) drawn, HS(3) | 2675 | 1.5 | 28 | 42.0 | 1.369 | 15,300 | 2589 |
| 303 | B | drawn | 1615 | 3.1 | 14 | 43.4 | 1.334 | — | 121 |
| 304 | B | drawn, HS(3) | 1879 | 2.4 | 24 | 57.6 | 1.355 | 9,800 | 694 |

TABLE IV-continued

| Run No. | Drawing Condition | Processing | Denier | Tenacity, (g/denier) | Elongation, % | Toughness | Density (g/cc) | Round Rod Abrasion | Corner Abrasion |
|---|---|---|---|---|---|---|---|---|---|
| 305 | B | drawn, HS,(3) solvent(4) | 1906 | 2.3 | 24 | 55.2 | 1.352 | 13,200 | 1340 |
| 306 | B | drawn, solvent,(4) HS(2) | 1825 | 1.9 | 20 | 38.0 | 1.365 | 20,000 | 1033 |
| 307 | B | drawn, solvent(4) | 1708 | 1.8 | 15 | 27.0 | 1.351 | 24,100 | 523 |
| 308 | C | drawn | 1643 | 2.5 | 13 | 32.5 | — | 19,000 | 339 |
| 309 | C | drawn, solvent(4) | 1699 | 2.5 | 11 | 27.5 | — | 24,360 | 459 |
| 310 | — | undrawn | — | — | — | — | — | 5,860 | 50 |
| 311 | — | undrawn, solvent(4) | — | — | — | — | — | 6,100 | >2400 |

(1)Solvent was $CH_2Cl_2$. Treatment for 2 hours; however, no visible change after first hour.
(2)HS = heatset at conditions equivalent to 200° C. for 10 minutes.
(3)Heatset continuously, in-line, at conditions equivalent to 200° C. for 10 minutes.
(4)Solvent was $CH_2Cl_2$. Treatment for 1 hour.

The data in Table IV show the changes in the physical properties of the PPS monofilament after solvent and/or heatset treatment. Denier and density, in all instances, were increased after treatment. Toughness changed after treatment and increased in some instances and decreased in others.

Round rod abrasion improved after treatment, except in one treatment sequence. If the monofilament was heatset after being solvent treated, the round rod abrasion was lower than monofilment that had been only solvent treated. Similar results were observed for the corner abrasion test.

These two abrasion resistance tests are laboratory simulations of abrasion on an actual fiber end product in use. When abrasion resistance is improved in both tests, the fiber end product is predicted to have a better abrasion resistance during actual use.

EXAMPLE IV

Table V shows the effect of various gasses on PPS monofilament. The samples were either heatset or heatset and treated with methylene chloride for one hour at 25° C. The treated sample was placed in a bomb and pressurized to about 0.5 atmospheres of the designated gas. The pressurized bombs were placed in an oven at about 220° C for about 24 hours. At the end of the 24 hour time period, the samples were analyzed for physical properties. The analyses shown in Table V were performed in the same manner as described in Example III.

TABLE V

| Run No. | Gas | Heatset(1) | $CH_2Cl_2$(2) | Denier | Tenacity, (g/denier) | Elongation, % | Toughness | % Loss Of Toughness | Density, (g/cc) |
|---|---|---|---|---|---|---|---|---|---|
| 401 | No Treatment | | | 1904 | 2.5 | 27 | 67.5 | — | 1.347 |
| 402 | Air | Yes | No | 1994 | 2.2 | 19 | 41.8 | 38.1 | 1.363 |
| 403 | $N_2$ | Yes | No | 1987 | 2.1 | 17 | 35.7 | 47.1 | 1.365 |
| 404 | $SO_2$ | Yes | No | 1941 | 1.5 | 10 | 15.0 | 77.8 | 1.365 |
| 405 | No Treatment | | | 1939 | 2.4 | 26 | 62.4 | — | 1.347 |
| 406 | Air | Yes | Yes | 1909 | 2.6 | 23 | 59.8 | 4.2 | 1.364 |
| 407 | $N_2$ | Yes | Yes | 1958 | 2.6 | 24 | 62.4 | 0 | 1.363 |
| 408 | $SO_2$ | Yes | Yes | 1953 | 2.5 | 21 | 52.5 | 15.9 | 1.366 |

(1)Heatset at conditions equivalent to 200° C. for 10 minutes.
(2)Treatment for one hour at 25° C.

Examination of the results listed in Table V show that nearly every monofilament sample lost toughness after the gas treatment. However, run numbers 506, 507, and 508, wherein the samples that were heatset and solvent-treated, had a lower percent loss of toughness than those samples that were only heatset, run numbers 502, 503, and 504. Once again, it is shown that treatment of a poly(arylene sulfide) fiber with an organic halide improves the physical properties of the fiber.

While this invention is described in detail for the purpose of illustration, it is not to be construed or limited thereby. These detailed examples are intended to cover all changes and modifications within the spirit and scope of the invention.

That which is claimed is:

1. A method of treating crystallizable poly(arylene sulfide) fiber comprising subjecting said poly(arylene sulfide) fiber to treatment with an organic halide.

2. A method according to claim 1 wherein said poly(arylene sulfide) is crystallizable poly(arYlene sulfide).

3. A method according to claim 1 wherein said poly(arylene sulfide) is predominately poly(para-phenylene sulfide).

4. A method according to claim 1 wherein said poly(arylene sulfide) fiber is a monofilament.

5. A method according to claim 1 wherein said poly(arylene sulfide) fiber is a multifilament.

6. A method according to claim 1 wherein said poly(arylene sulfide) fiber is a staple.

7. A method according to claim 1 wherein said halide is selected from the group consisting of chloride, bromide, iodide, and mixtures of two or more thereof.

8. A method according to claim 1 wherein said organic halide is an aromatic halide.

9. A method according to claim 1 wherein said organic halide is an aliphatic halide.

10. A method according to claim 9 wherein said aliphatic halide is an aliphatic chloride.

11. A method according to claim 9 wherein said aliphatic chloride is dichloromethane.

12. A method according to claim 1 wherein treating temperature is in the range of about 0° to about 150° C.

13. A method according to claim 1 wherein said temperature is in the range of about 10° to about 35° C.

14. A method according to claim 1 wherein treating time is in the range of about one minute to about 72 hours.

15. A method according to claim 1 wherein said time is in the range of about 15 minutes to about 3 hours.

16. A method according to claim 1 wherein said fiber is heat treated at a temperature in the range of about 100° to about 270° C., for a time in the range of about one-half second to about 30 minutes before treatment with said organic halide.

17. A method according to claim 1 wherein said fiber is heat treated at a temperature in the range of about 100° to about 270° C., for a time in the range of about one-half second to about 30 minutes after treatment with said organic halide.

18. A poly(arylene sulfide) fiber composition produced by the method of claim 1.

19. A poly(arylene sulfide) fiber composition produced by the method of claim 16.

20. A poly(arylene sulfide) fiber composition produced by the method of claim 17.

21. A method of treating crystallizable, drawn poly(arylene sulfide) monofilament comprising subjecting said poly(arylene sulfide) monofilament to treatment with methylene chloride at a temperature in the range of about 0° to about 150° C. for a time in the range of about one minute to about 72 hours.

22. A method according to claim 21 wherein said monofilament is heat treated at a temperature in the range of about 100° to about 270° C., for a time in the range of about one-half second to about 30 minutes, after the methylene chloride treatment.

23. A poly(arylene sulfide) monofilament composition produced by the method of claim 21.

24. A poly(arylene sulfide) monofilament composition produced by the method of claim 22.

* * * * *

UNITED STATES PATENT AND TRADEMARK OFFICE

CERTIFICATE OF CORRECTION

PATENT NO. : 4,923,971

DATED : May 8, 1990

INVENTOR(S) : Bruce L. Ramsey

It is certified that error appears in the above-identified patent and that said Letters Patent is hereby corrected as shown below:

Column 8, claim 2, line 33, "poly(arYlene sulfide" should read --- poly(arylene sulfide) ---.

Signed and Sealed this

First Day of October, 1991

*Attest:*

HARRY F. MANBECK, JR.

*Attesting Officer*

*Commissioner of Patents and Trademarks*